US012077262B2

(12) United States Patent
McNaughton

(10) Patent No.: US 12,077,262 B2
(45) Date of Patent: Sep. 3, 2024

(54) PORTABLE, PUMPLESS LIQUID WATER WEIGHT BALLAST SYSTEM

(71) Applicant: Patrick McNaughton, Plymouth, MN (US)

(72) Inventor: Patrick McNaughton, Plymouth, MN (US)

( * ) Notice: Subject to any disclaimer, the term of this patent is extended or adjusted under 35 U.S.C. 154(b) by 534 days.

(21) Appl. No.: 17/138,862

(22) Filed: Dec. 30, 2020

(65) Prior Publication Data

US 2021/0197936 A1 Jul. 1, 2021

Related U.S. Application Data

(60) Provisional application No. 62/958,617, filed on Jan. 8, 2020, provisional application No. 62/955,970, filed on Dec. 31, 2019.

(51) Int. Cl.

| | |
|---|---|
| ***B63B 43/06*** | (2006.01) |
| ***A45C 11/20*** | (2006.01) |
| ***A45F 3/04*** | (2006.01) |
| ***B65D 25/28*** | (2006.01) |

(52) U.S. Cl.

CPC ..... *B63B 43/06* (2013.01); *A45C 11/20* (2013.01); *A45F 3/04* (2013.01); *B65D 25/2873* (2013.01); *B63B 2207/02* (2013.01); *B65D 2313/02* (2013.01); *B65D 2525/288* (2013.01)

(58) Field of Classification Search

CPC ..... B63B 43/00; B63B 43/06; B63B 2207/02; B65D 25/2873; B65D 2525/288; B65D 2313/02; A45C 11/00; A45C 11/02; A45F 3/00; A45F 3/04

USPC ..... 114/125

See application file for complete search history.

(56) References Cited

U.S. PATENT DOCUMENTS

| | | | | |
|---|---|---|---|---|
| 5,787,835 A * | 8/1998 | Remnant | B63B 1/32 114/125 |
| 8,911,334 B1 * | 12/2014 | Cotter | A63B 21/4005 482/111 |
| 10,781,028 B2 * | 9/2020 | Munie | A45F 3/04 |

* cited by examiner

*Primary Examiner* — Lars A Olson

(74) *Attorney, Agent, or Firm* — Skaar Ulbrich Macari, P.A.

(57) ABSTRACT

A portable, pumpless water ballast system can be constructed of a flexible water-proof membrane molded or formed of welded panels to make a desired shape, such as cube-shaped when filled with water. Along the top side is an opening for filling the container. A water-proof closure is provided in the opening to prevent water leaking out. An air release valve can be installed near the top area of the container's top or side panels. A handle or strap can also be provided on one or more of the adjacent sides of the container. A plastic threaded drain and closure can be provided on one or more sides to allow for emptying of the container or to attach other features like a hose or other accessory.

18 Claims, 19 Drawing Sheets

PORTABLE, PUMPLESS LIQUID WATER WEIGHT BALLAST SYSTEM

PRIORITY

This application claims the priority benefit of U.S. Provisional Application No. 62/955,970, filed on Dec. 31, 2019, and U.S. Provisional Application No. 62/958,617, filed on Jan. 8, 2020, both of which are hereby incorporated herein by reference in their entirety.

FIELD

The present invention relates to boating accessories, and more particularly, to a portable, pumpless liquid water weight ballast system.

BACKGROUND

Typically the use of additional ballast weight pumped into or brought onto a boat is used to customize the displacement of the boat's hull into the body of water. While underway, the heavier boat will displace more water. This will affect the boat's wake size and shape. Added ballast can also correct or intentionally list the boat port or starboard. In some occurrences, while only cruising, portable and movable ballast can be used to offset an uneven distribution of passenger weight that causes listing.

There two primary types of water ballast currently used on sport watercraft 1) built-in to boat permanently and 2) portable.

The built-in to boat permanently type is usually provided by the boat manufacturer at the factory. In some cases this can also be provided as an aftermarket addition where people will buy a system and install it into a boat that they already own. Both use permanently mounted bags or tanks in the boat with corresponding permanent pumps, plumbing and electrical connectors. These systems have water transfer pumps that are wired into the boat's electrical system and actual holes drilled through the boat's hull for water inlets and outlets. Such systems are permanent because removal would take time, tools, and leave the boat un-seaworthy until major repairs were made to the breaches in the boat's hull. With a permanent system, all water containers or tanks are in a fixed position. There may be one or many pumps and water storage compartments that are typically operated by one or more switches at the helm of the boat.

Portable type ballast is typically one or more heavy duty vinyl material bags designed to hold 200 to 1200 pounds of water each and an electric pump that has an accessory plug end (to plug into a cigarette-style power plug) or alligator clips (to attach to the boat's battery). The pumps are high flow rate typically ranging from 600 GPH to 4000 GPH.

The vinyl bags are positioned where the boat operator wants them with no bands or straps that would make them permanent. One by one, each bag is filled by the user using the portable high-volume pump and a hose to draw water out of the lake or other body of water that the boat is floating in. The same pump and "one-by-one" fill method is also used to empty each previously-filled bag.

The numerous items of equipment needed to use on the boat in a "portable arrangement" takes up considerable space in storage lockers, on floors, on seats and in other available compartments. There is a dependence on the pump and its need to operate properly to transfer water in and out of the bags. If the pump should break or if the fuse to the pump burns out, the user cannot transfer the water in or out of the bags. The latter is the more serious problem because there may be 100 s or even 1000 s of pounds of water ballast in the boat that cannot be removed. This can make it difficult, and even unsafe, to navigate back to shore, to trailer, to dock, etc.

A variation of portable ballast is to use lead, sand or other dense material put into bags with handles instead of filling bags with water. A benefit of these alternatives is that they require no pumps. Obviously, the bags cannot be too heavy or an individual operator would not be able to move them. The operator must place one or more of the weighted bags into their boat. For example, four 50 pound bags of lead may be used to provide 200 pounds of additional ballast. A boat operator may use these alone or with a traditional "built in" or "portable" systems mentioned above. Many times the portable static weights are used with other systems to fine tune a boat wake and performance while underway. These weights of sand, lead or other dense material are static. They are not designed to fill and release with each use as the other systems mentioned above. These weights are clumsy and awkward to use and move around the boat, from boat to dock, from land to boat or trailer. There is additional awkwardness and potential safety hazard because these weights typically stay in the boat because of the inconvenience of loading and unloading. This also wastes fuel Boats are typically matched in load and capacity for the trailers that haul them. Additional ballast weight is not taken into consideration when most boats and trailers are purchased. Also, for boats that are not trailered, but instead are stored on boat lifts, the same case is true. The boats and their lifts are paired so that the lift will adequately hold the weight of the boat and not additional concentrated static weight. The added static weight in the boat all the time during normal operation, even when not doing water sports, is an unnecessary weight and drag while cruising or other boating activities. Far more fuel is consumed when additional weight is in the boat. This added weight will also alter the handling of the boat while simply cruising and not needing them for water sports displacement of the boats hull. Once in the boat it is cumbersome to remove the static weight. The static weight also has no buoyancy and can ultimately play a role in the sinking of a boat.

Thus, the use of materials such as lead, sand or other dense materials put into a bag presents at least the following drawbacks:

1) the ballast is not designed to fill and empty with each use;
2) the ballast is difficult and awkward to move in and out of boat, from land to boat, boat to land and boat to dock, etc.;
3) the ballast is potentially hazardous, is not buoyant and can contribute to a boat sinking;
4) trailers and boat lifts are not designed to carry the additional static weight of the ballast;
5) the ballast is difficult to store since it cannot be compacted and easily moved around, such as to lift out from under boat lockers, cushions and other side storage areas;
6) when weighted bags are exposed overt time to moisture from being in a boat, they can get moldy, discolor and stain carpet and cushions; and
7) if the bags should tear or rip, the lead, sand or other material in the bag can make a mess in the boat, and the bags are then no longer useable.

Therefore, there is a continuing need to provide a small, easy-to-use and convenient portable pumpless ballast solution.

SUMMARY

Provided is a portable pumpless ballast device, system and method that can be used, for example, on water-sport boats to create the desired wake size and shape for wake boarding, wake surfing and slalom skiing, etc. The ballast can also be used for other recreational boating activities that are not specifically for a water sport, but rather for cruising and other general uses.

Disclosed is a portable water ballast container or weight. The container is not permanently mounted into the boat. Instead, it acts independently of any other system in or on the boat. The ballast does not require any pump, electric or other powered means to transfer water in and out of the container. The ballast is not a static weight. It is a hollow container specifically designed to be easily filled with water without the need for a pump and also evacuated while on the boat with each use.

The portable, pumpless liquid water weight ballast system can comprise a flexible water-proof membrane molded into a shape that can hold water inside of it, or welded together from separate panels to form the desired water-holding shape. The ballast system can be generally cube-shaped when filled with water. Along the top side is a large opening in the panel for filling the container. The opening can extend longitudinally substantially the entire width of the top panel and can even extend down one or both of the sides partially or entirely. A water-proof closure is provided in the opening to prevent water leaking out. An air release valve can be installed near the top area of the container's top or side panels. A handle or strap can also be provided on one or more of the adjacent sides of the container. A plastic threaded plug can be provided on one or more sides to allow for emptying of the container or to attach other features like a hose or other accessory.

The water volume in use can be added and released to adjust the weight of the ballast, for example from 1 lb. to 50 lbs. Unlike static weight such as sand, lead and other dense material that must be moved onto and off the boat, the present ballast system can be filled with the abundance of water immediately available to the user from the body of water. Plus, using water as the weight over other solid and heavy materials like lead offers the advantage that water is easily evacuated at will or in an emergency. Indeed, the water in the bag need not be emptied, just moved overboard, since the bag would be net neutrally buoyant in the body of water.

The ballast container is constructed of a flexible material that can be emptied, rolled folded or smashed to store in very small places when not in use. There are other features of this device that enable it to work alone as one or as a system of several or many.

The container can also be configured to hold a small static weight to help sink the container when filling and to boost the overall weight without adding a lot of volume to the overall container. The majority of the ballast weight is water.

In an example embodiment, a portable, pumpless liquid water weight ballast system can comprise a container comprising a flexible and waterproof material, and defining an open interior, an openable closure defined along a top side of the container so that the container can be sealed water-tight, an air release valve provided to a portion of the container that is in communication with the open interior, and a handle coupled to the container.

A threaded fitting can be defined in the container and in communication with the open interior. A threaded closure can seals the threaded fitting. A hose can be coupled to the threaded fitting on a first end and a nozzle can be coupled to an opposing second end of the hose. Other accessories can be attached to the hose.

A stiffener sheet disposed in one or more side panels of the container to add stiffness where desired.

The container can be a wide variety of regular and irregular shapes, including rectangular, polygonal, cylindrical, etc.

The openable closure can be a zipper, an interlocking seal, a rolled section of material or other water-tight sealing means.

One or more baffles can be disposed within the open interior of the container.

A first portion of hook and loop fastener can be disposed on a first planar portion of the container. A second portion of hook and loop fastener can be disposed on a second planar portion the container. The second portion of hook and loop fastener is an opposite configuration as compared to that of the first portion of hook and loop fastener. The planar portions can be on opposite sides of the container so that the container can be securely joined with additional similarly-configured containers. A flap can cover over the hook and loop fastener portions when not being used.

The container can define an open top side. A strap can be positioned to hold a rolled portion of the container in a position that encloses the open top side.

A static weight such as a metal plate can be provided to container. A pocket can be defined in the container for receiving a removable static weight.

A one-way inlet valve can be defined in the container that is in communication with the open interior.

A pair of opposing side panels of the container can be collapsible to permit contraction of the container along the pair of opposing side panels that are collapsible.

In another example, a portable, pumpless liquid water weight ballast system can include two containers, each container comprising a flexible and waterproof material, and defining an open interior, wherein the container includes an openable closure defined along a top side of the container so that the container can be sealed water-tight. A first container includes a first portion of hook and loop fastener disposed on a first planar portion of the first container. A second container includes a second portion of hook and loop fastener disposed on a second planar portion of the second container. The second portion of hook and loop fastener is complimentary to the first portion of hook and loop fastener such that when the first and second portions of hook and loop fastener are aligned and brought into contact with one another, the respective first and second containers are secured together.

In a further example, a method of providing portable ballast to a boat is provided. The method can include submerging a container comprising a flexible and waterproof material underwater to fill an open interior thereof with water from a body of water, sealing an openable closure of the container to prevent water contained in the open interior from escaping the container, and disposing the container that has been filled with water and sealed in a boat. A static weight can be disposed in the container before submerging the container underwater.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

Figure 1:
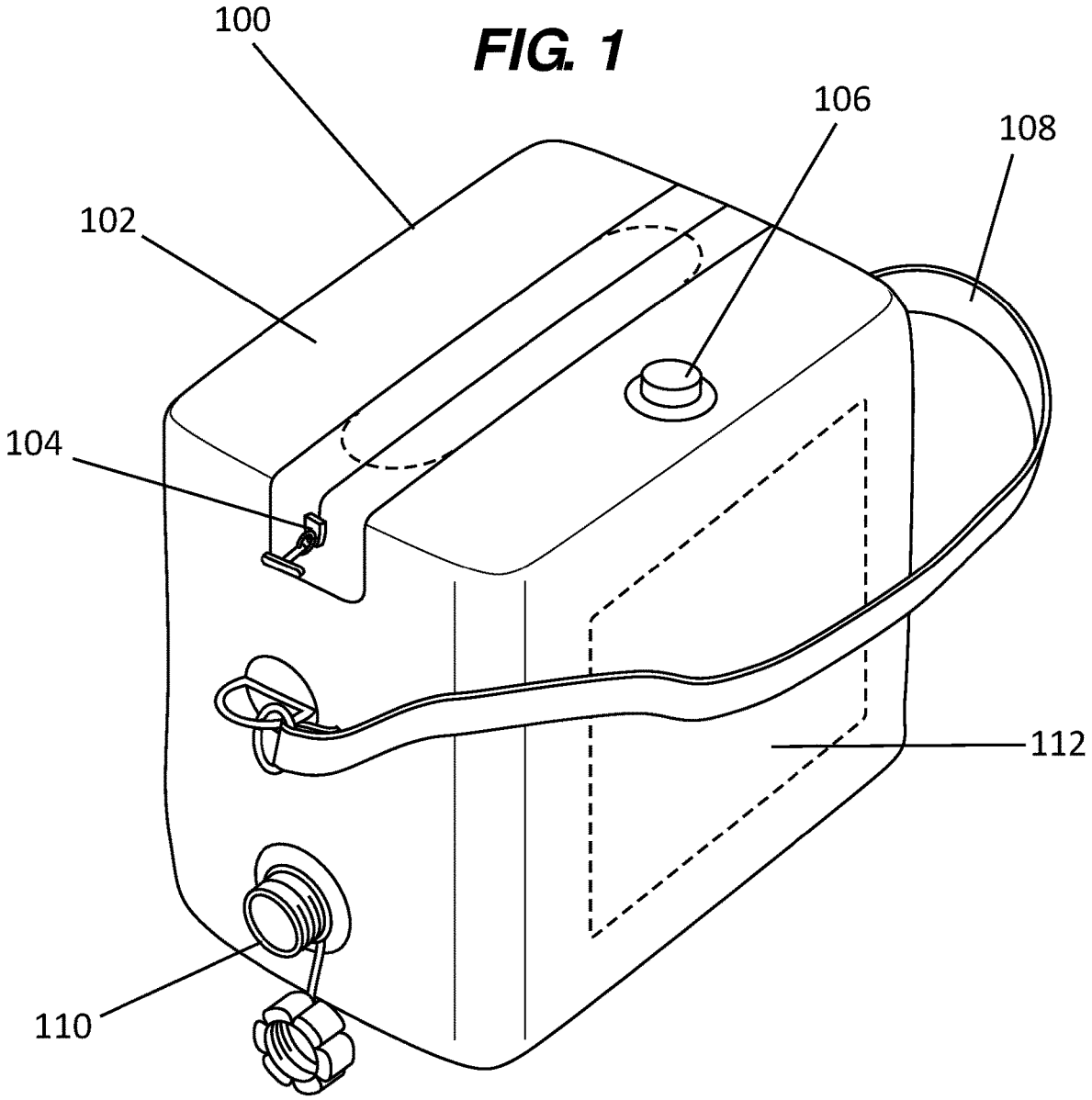
FIG. 1 is a perspective view of a portable water weight in accordance with certain aspects of the invention.
Figure 2:
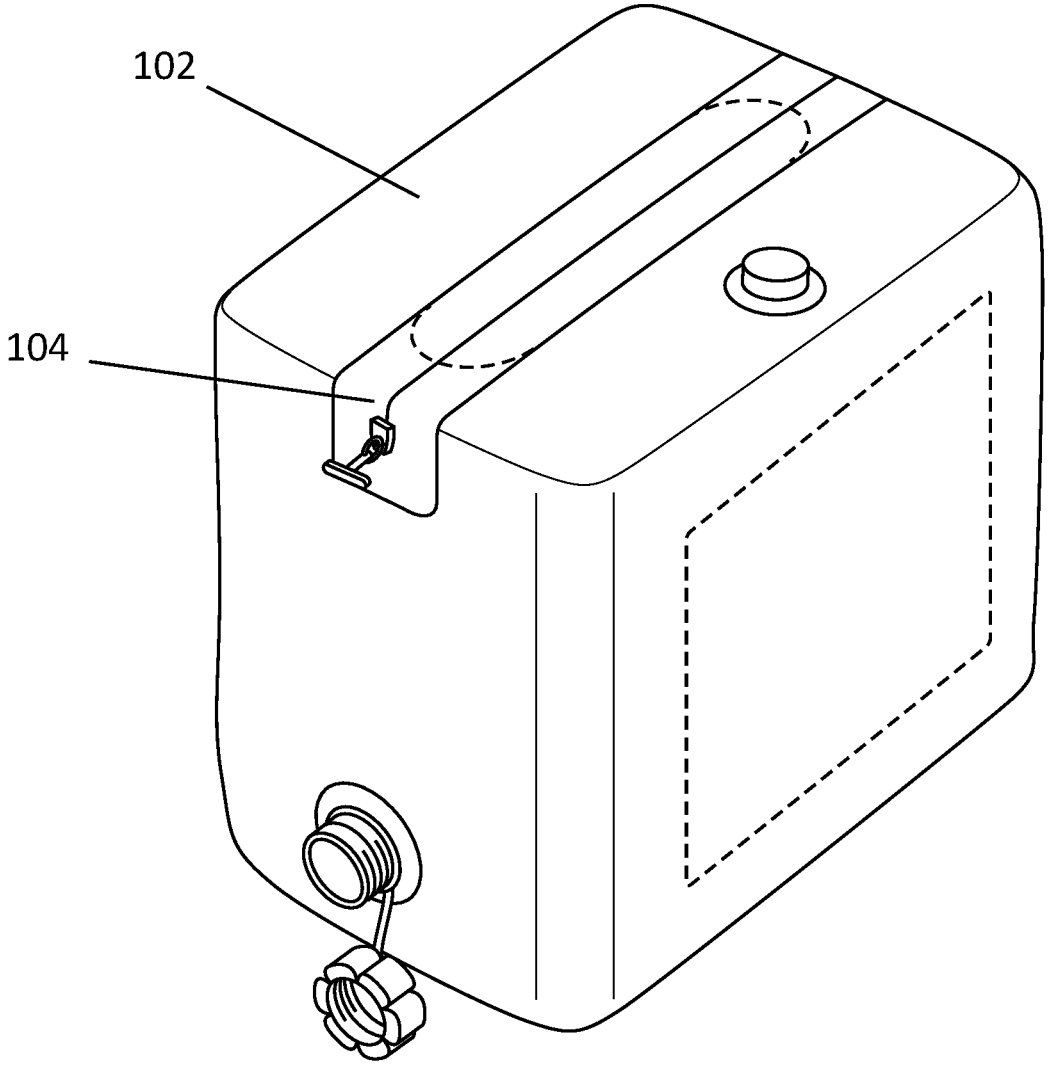
FIG. 2 is a perspective view of a portable water weight in accordance with certain aspects of the invention.
Figure 3:
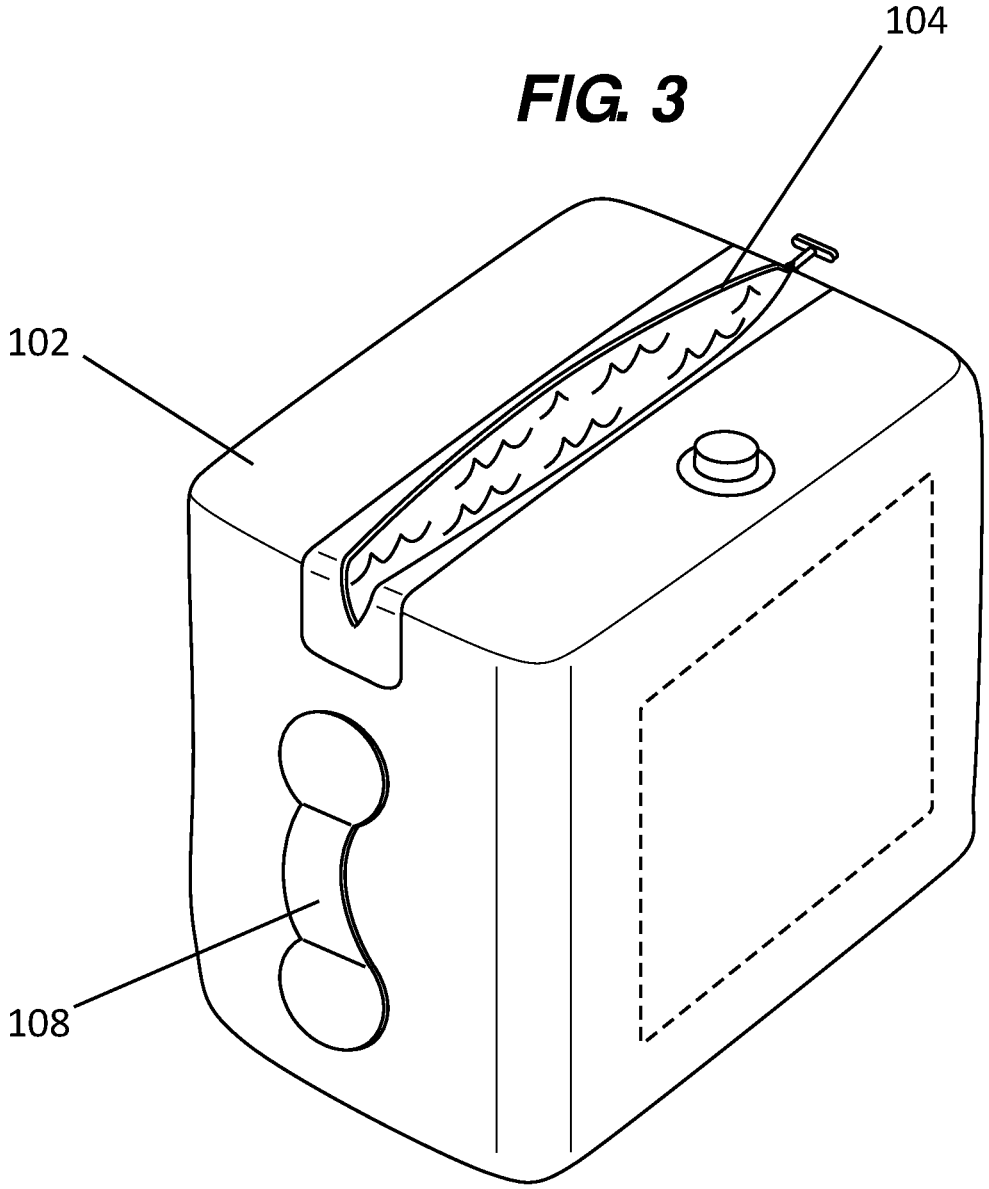
FIG. 3 is a perspective view of a portable water weight in accordance with certain aspects of the invention.

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The invention is to cover all modifications, equivalents, and alternatives falling within the scope of the invention as defined by the appended claims.

The various features or aspects discussed herein can also be combined in additional combinations and embodiments, whether or not explicitly discussed herein, without departing from the scope of the invention.

Referring generally to FIGS. 1-28, the portable, pumpless liquid water weight ballast system 100 can comprise a flexible water-proof membrane molded or welded from multiple panels to form a desired hollow shaped container or body 102. Nylon, PVC or Tarpaulin are examples of materials that are flexible, durable and effective for molding or welding the panels together to form the body 101.

In a first embodiment, the ballast system 100 is generally a hollow cube-shaped container 102 that can be filled with water. However, the length, width and depth do not have to be the same dimensions. An openable closure 104 is defined along the top side in the panel that extends longitudinally across the width of the top side. The openable closure 104 can also further span partially or entirely down one or both vertical sides as well. The openable closure 104 includes a water-proof seal, such as a zipper or an interlocking seal (e.g., ZIP-LOCK) type mechanism or a rolled top, which closes the openable closure in a water-tight manner when the container 102 is full of water so that there is no leaking.

An air release valve 106 can be installed near the top area of the top or side panels. This valve can aid in evacuating air from the container 102 during a filling procedure, or after sealing.

A handle or strap 108 can be attached (or removably attached) to one or more of the adjacent sides of the container 102 for easy handling of the container 102.

A threaded fitting 110 can be defined in the container and in communication with the open interior. The threaded fitting includes a threaded closure that seals the threaded fitting. For example, a plastic threaded plug 110 can be disposed in one or more of the container sides, and preferably adjacent to the bottom side, to allow for easily emptying the water in the container. The plug can also be used to attach various accessories, such as a hose 111*a* and nozzle 111*b* (FIG. 16), shower wand, etc. The valve 106 or openable closure 104 can be opened when the plug 110 is removed to aid in efficient draining of the water.

Figure 6A:
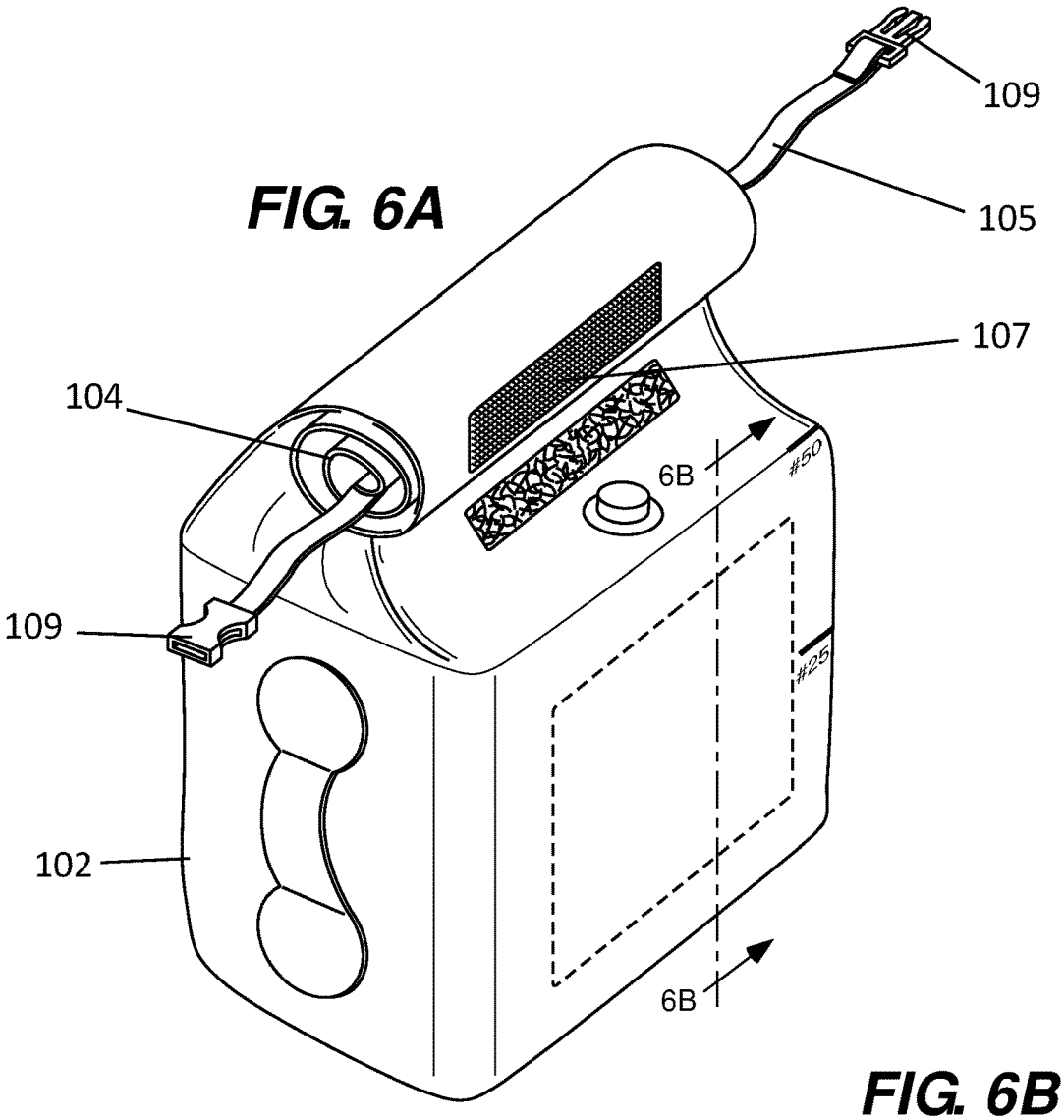
FIG. 6A is a perspective view of a portable water weight in accordance with certain aspects of the invention.
Figure 6B:
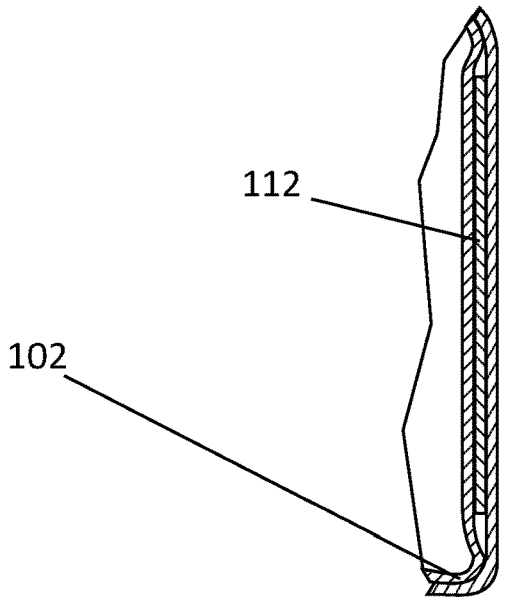
FIG. 6B is a diagram of a rigid sheet material for a portable water weight in accordance with certain aspects of the invention.
Figure 6C:
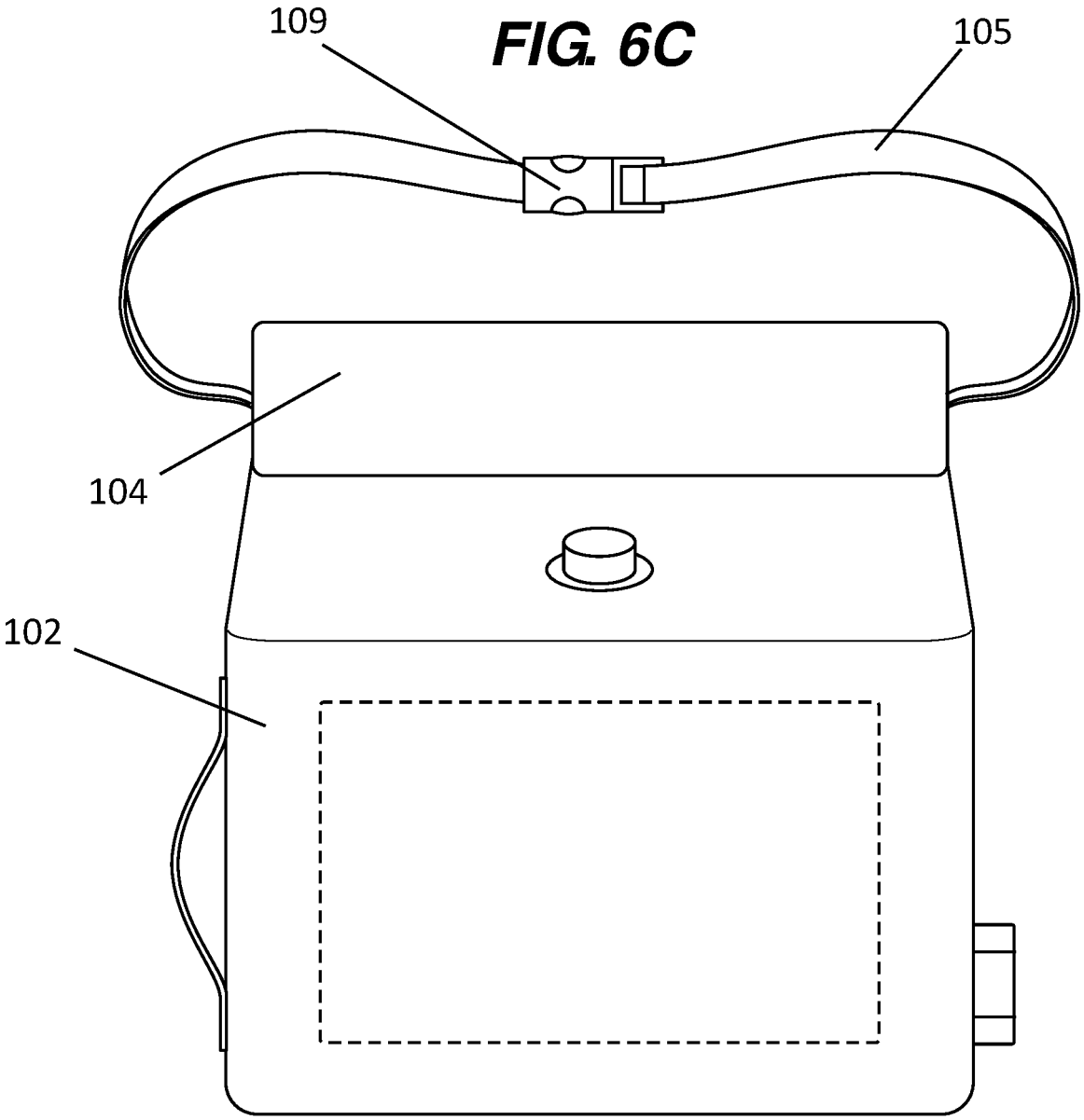
FIG. 6C is a front view of a portable water weight in accordance with certain aspects of the invention.

One or more of the side panels forming the container 102 can include a stiffener sheet of material 112 embedded therein. The stiffener sheet 112 makes the otherwise flexible material of the panel stiffer. A side cross-section of a side panel showing the embedded sheet 112 is shown in FIG. 6B. The stiffener sheet 112 can be provided if and where desired to add further rigidity to one or more portions of the container, or can be omitted entirely.

Figure 12:
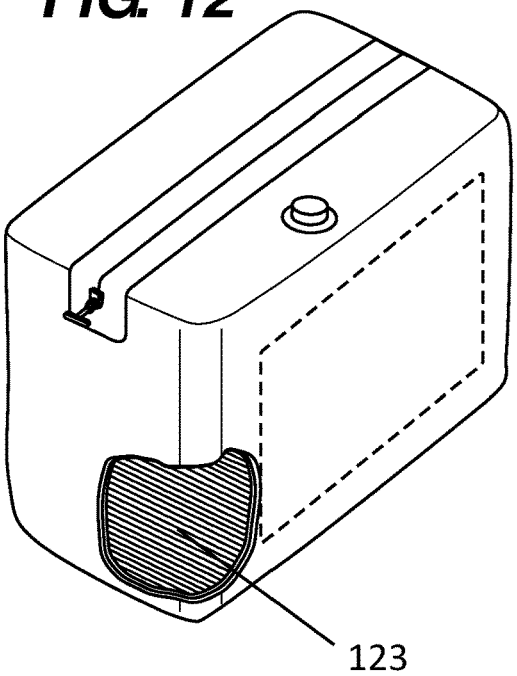
FIG. 12 is a perspective view of a portable water weight in accordance with certain aspects of the invention.
Figure 13:
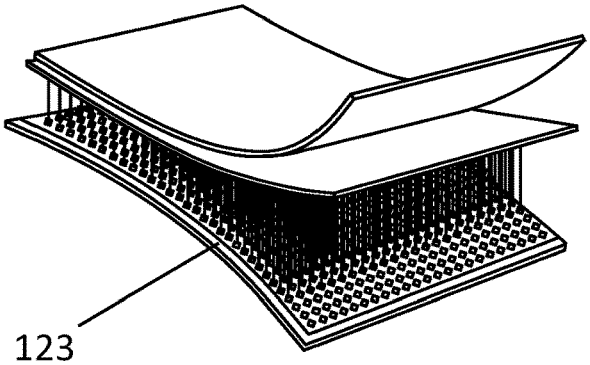
FIG. 13 is a perspective diagram of a sheet material for a portable water weight in accordance with certain aspects of the invention.

The container 102 can also be provided with one or more interior baffles 113 (FIG. 11) or a manufacturing process called drop-stitching 123 (FIGS. 12-13). These features help the container 102 to hold its intended shape even with the forces of the water's outward pressure in all directions. The baffles 113 also minimize side-to-side sloshing of the water in the container.

The stiffening means mentioned above allow for a flatter and larger contact area of the container 102 so that two or more containers can be joined together.

Figure 14:
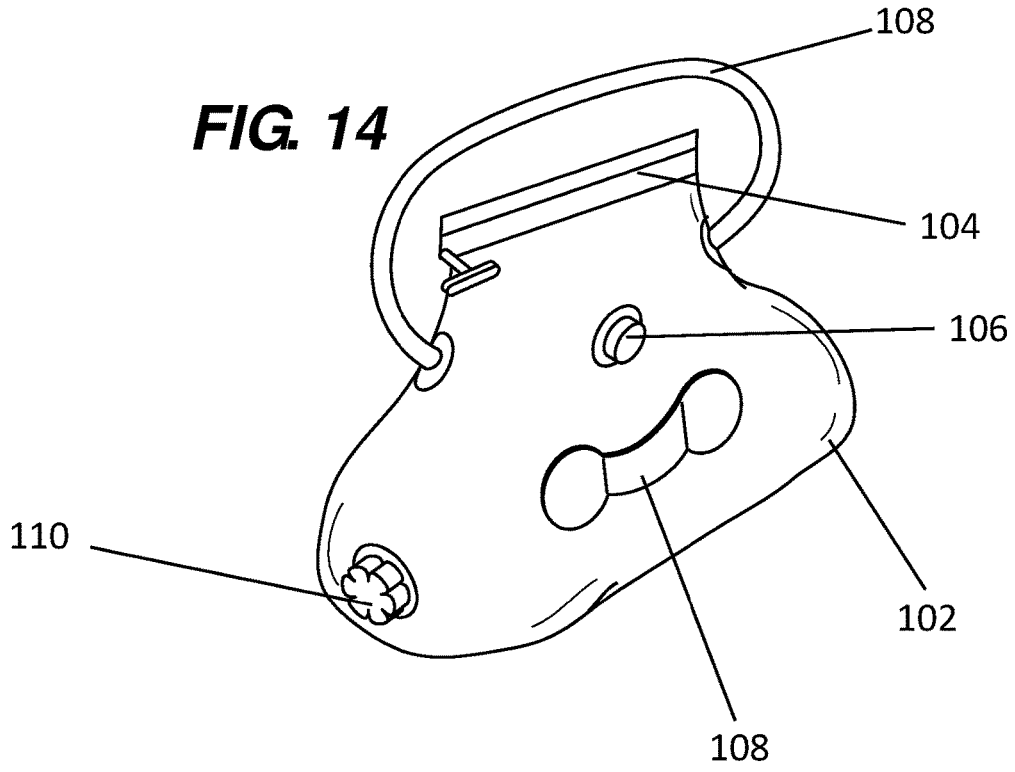
FIG. 14 is a perspective view of a portable water weight in accordance with certain aspects of the invention.
Figure 15:
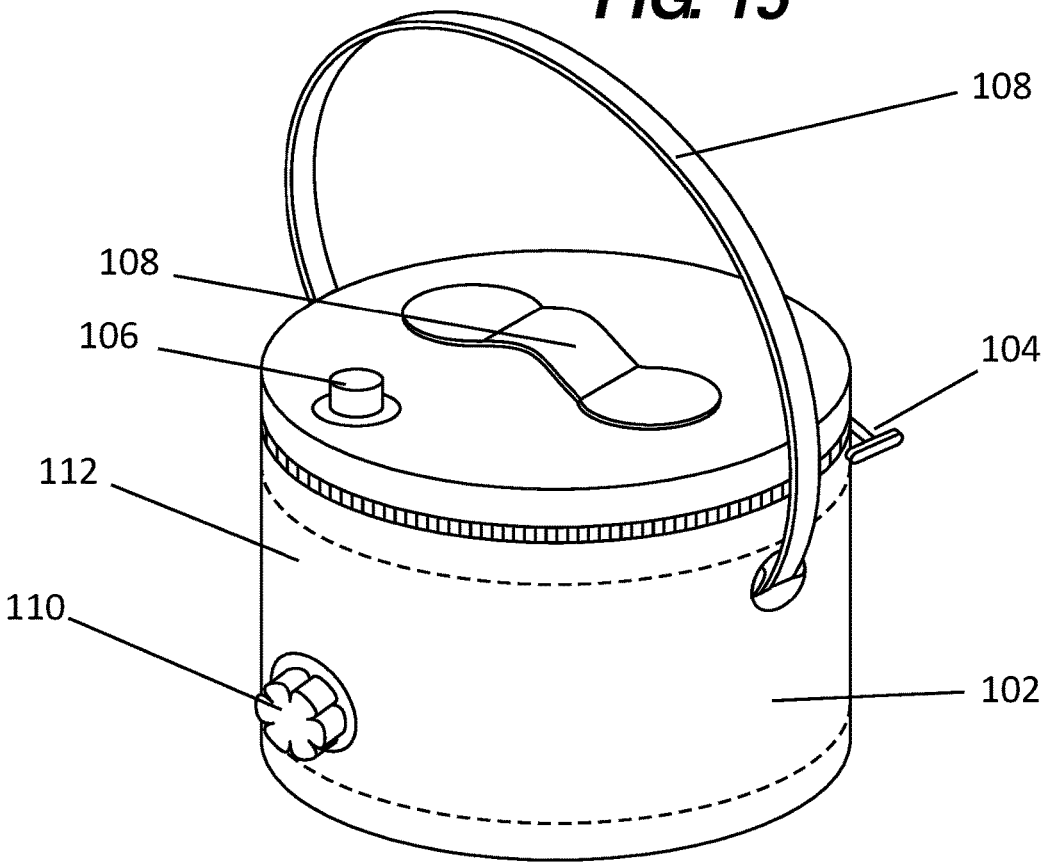
FIG. 15 is a perspective view of a portable water weight in accordance with certain aspects of the invention.
Figure 16:
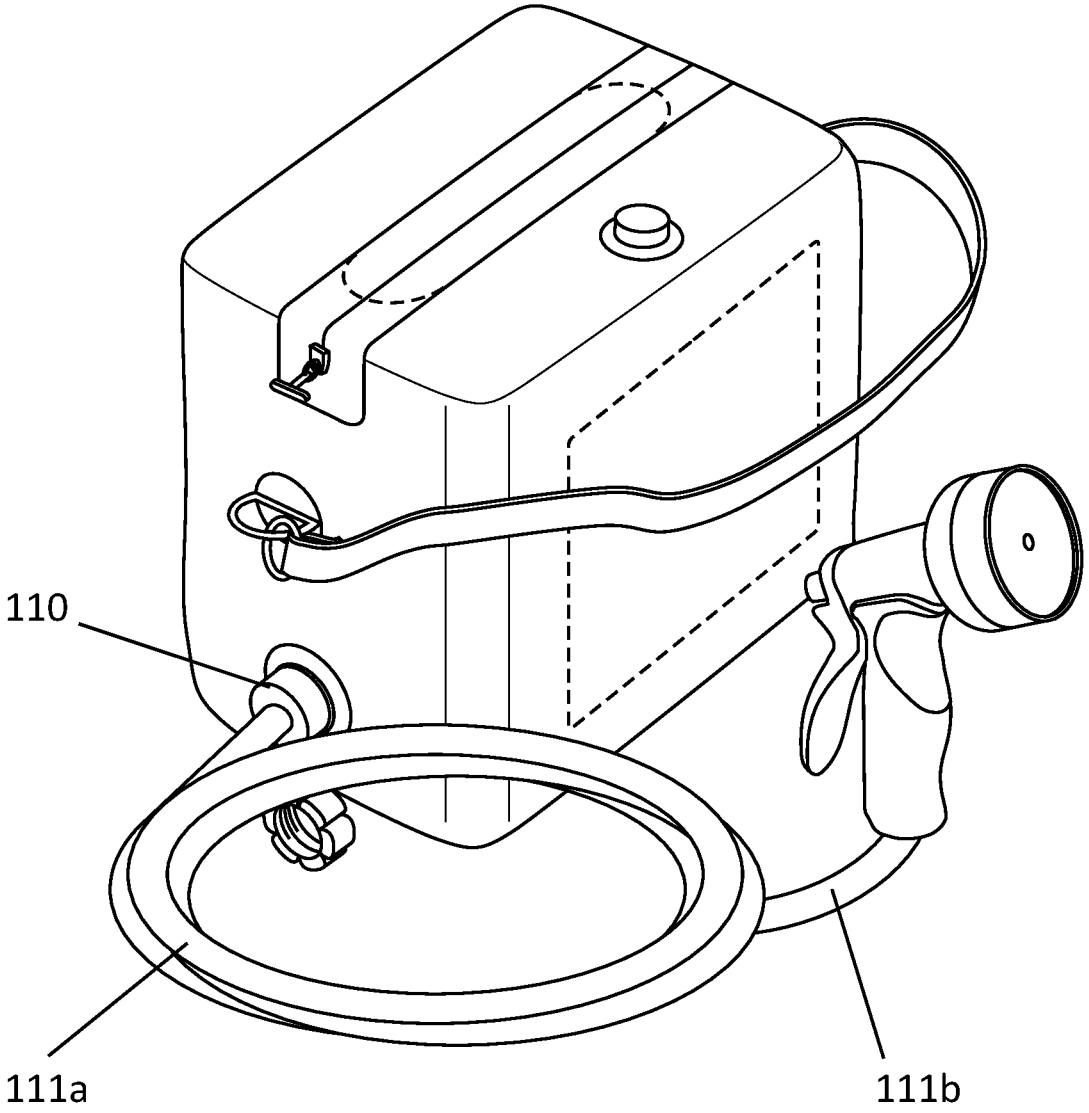
FIG. 16 is a perspective view of a portable water weight in accordance with certain aspects of the invention.
Figure 17:
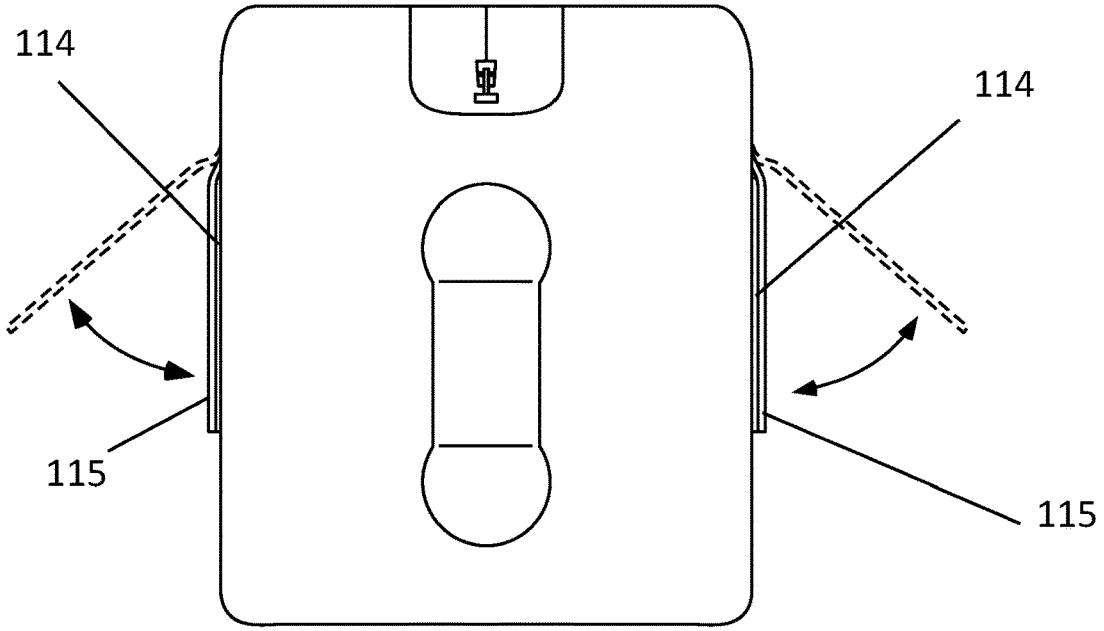
FIG. 17 is a side view of a portable water weight in accordance with certain aspects of the invention.
Figure 18:
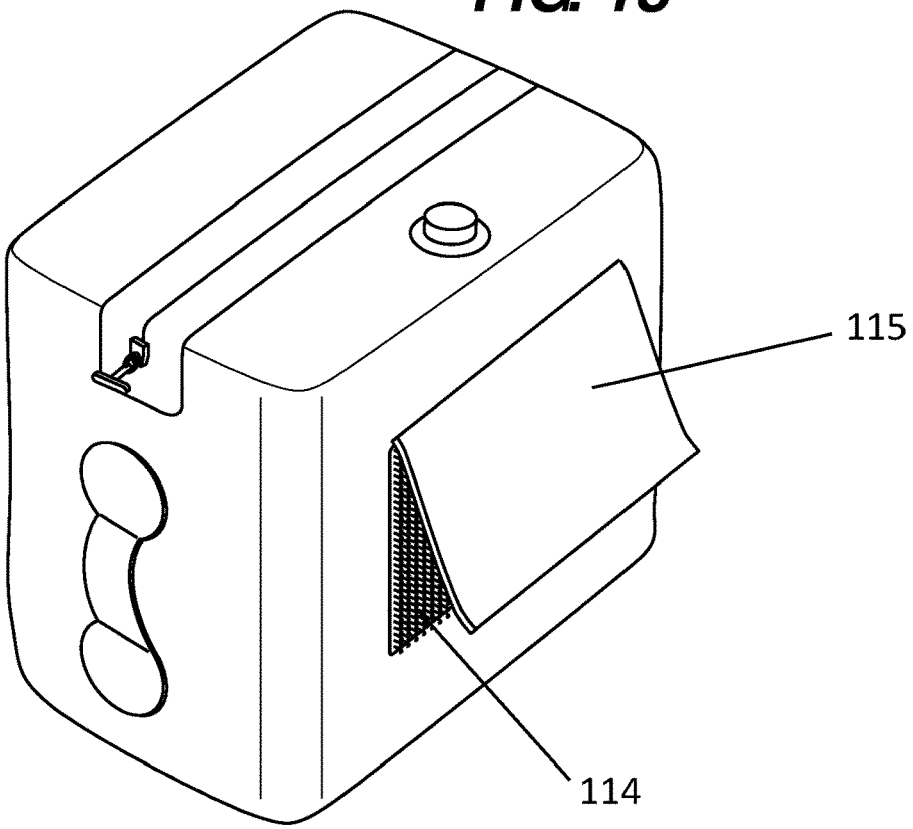
FIG. 18 is a perspective view of a portable water weight in accordance with certain aspects of the invention.
Figure 19:
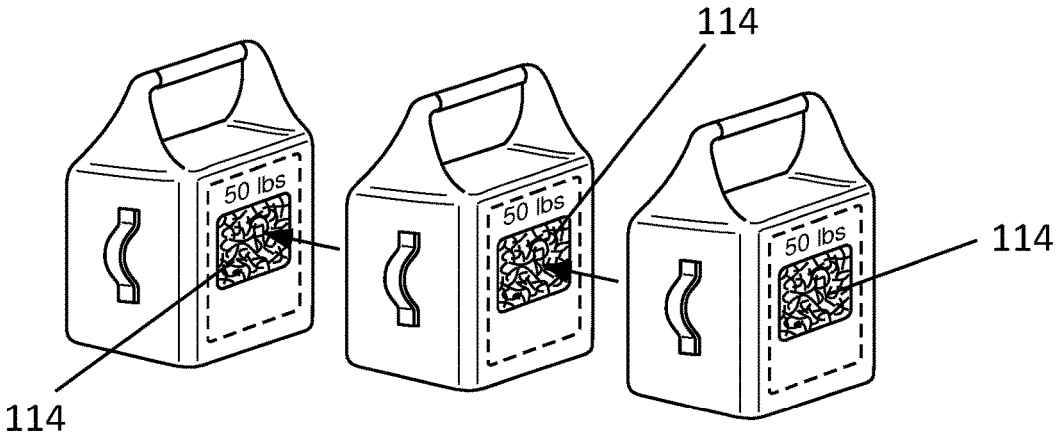
FIG. 19 is a perspective view of multiple portable water weights to be joined together in accordance with certain aspects of the invention.
Figure 20:
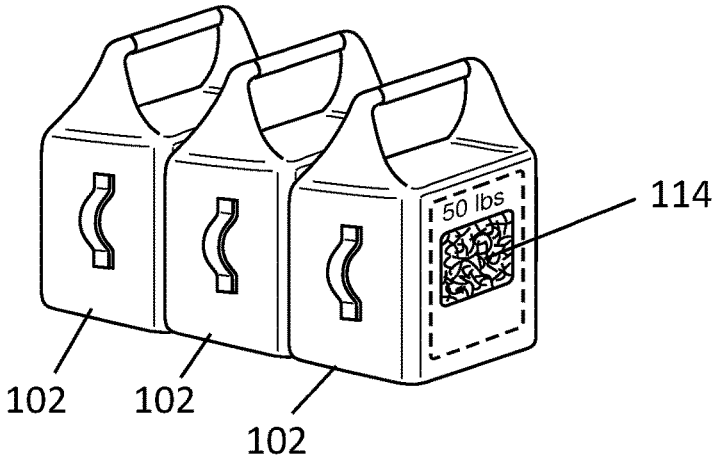
FIG. 20 is a perspective view of multiple portable water weights joined together in accordance with certain aspects of the invention.
Figure 21:
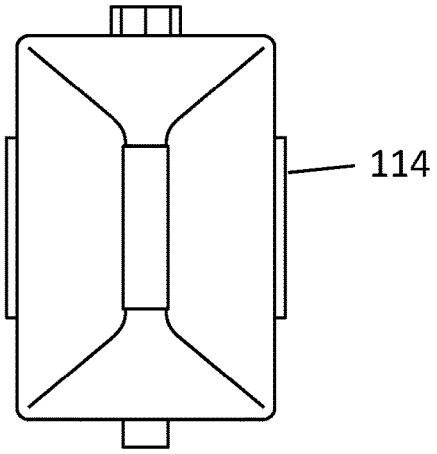
FIG. 21 is a top view of a portable water weight in accordance with certain aspects of the invention.
Figure 22:
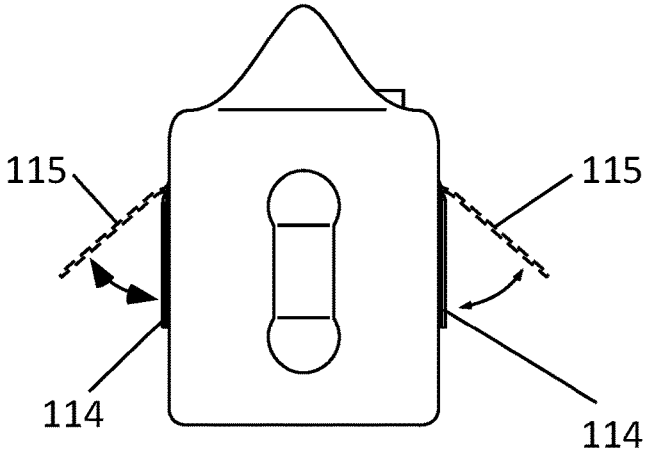
FIG. 22 is a side view of a portable water weight in accordance with certain aspects of the invention.
Figure 23:
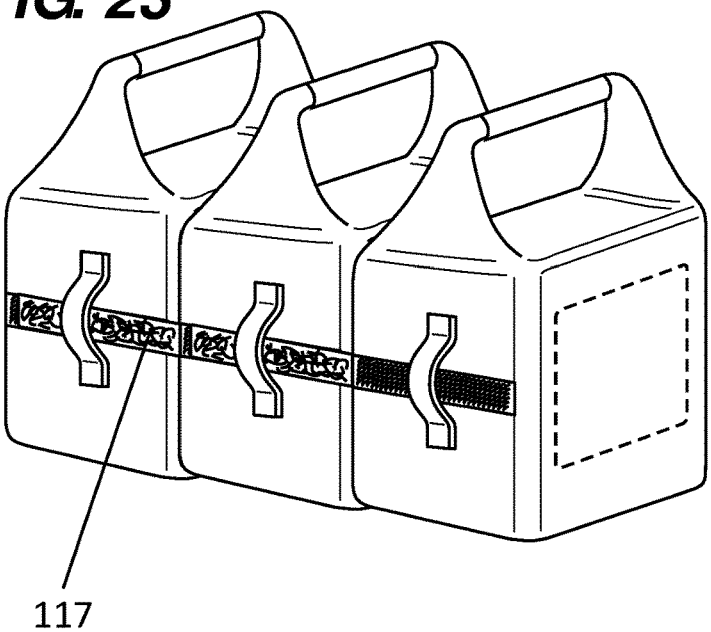
FIG. 23 is a perspective view of multiple portable water weights joined together in accordance with certain aspects of the invention.
Figure 24:
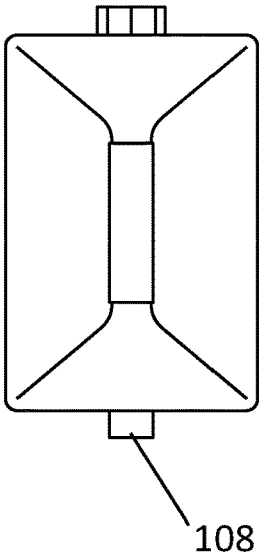
FIG. 24 is a top view of a portable water weight in accordance with certain aspects of the invention.
Figure 25:
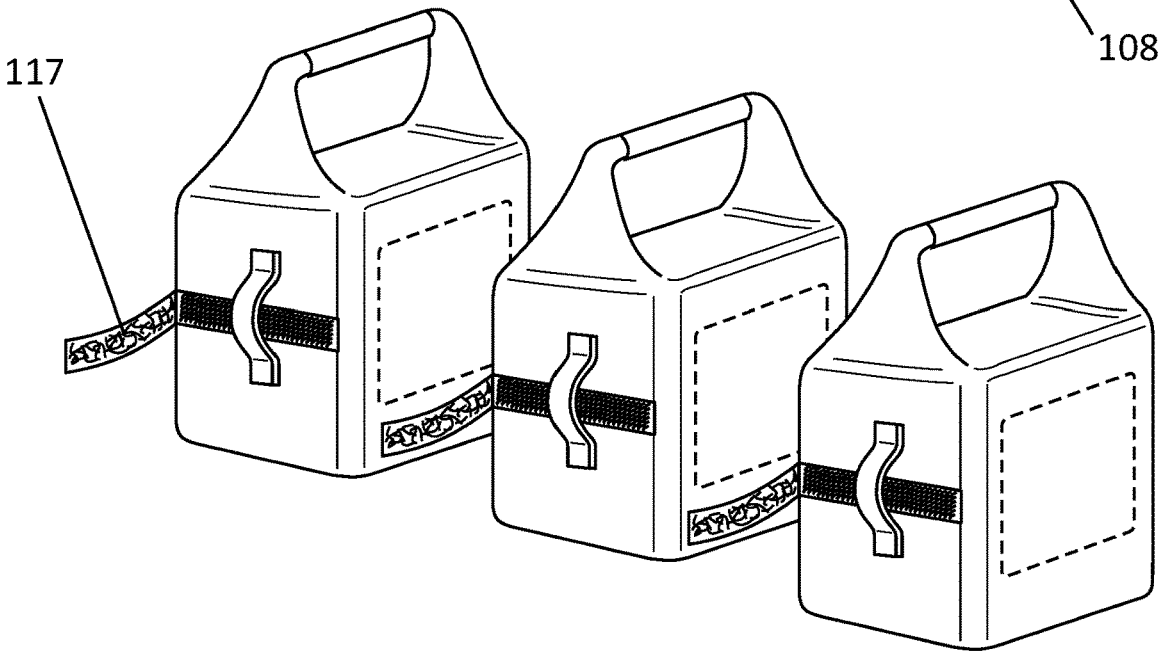
FIG. 25 is a perspective view of multiple portable water weights to be joined together in accordance with certain aspects of the invention.
Figure 26A:
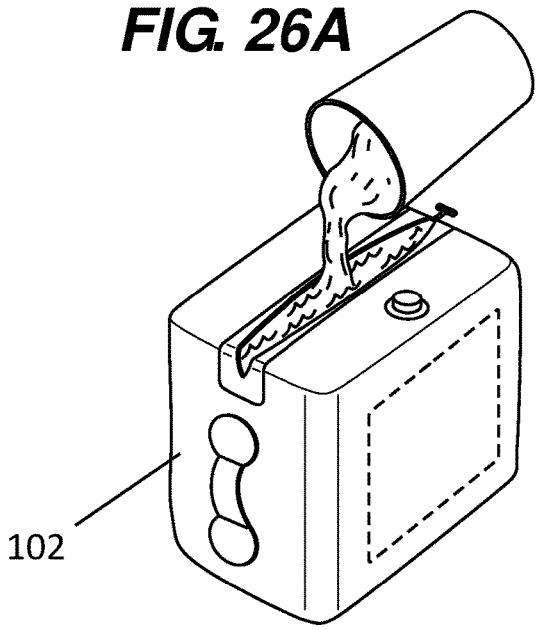
FIGS. 26A-26D are a series of diagrams showing a filling procedure for a portable water weight in accordance with certain aspects of the invention.
Figure 26B:
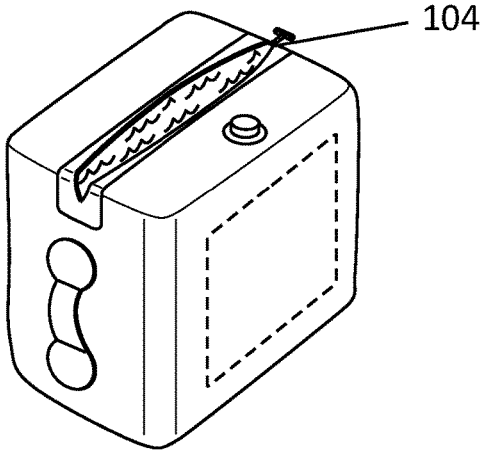
Figure 26C:
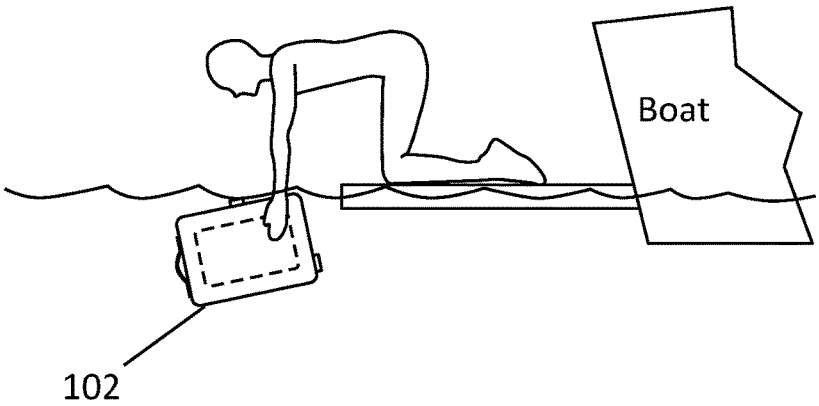
Figure 26D:
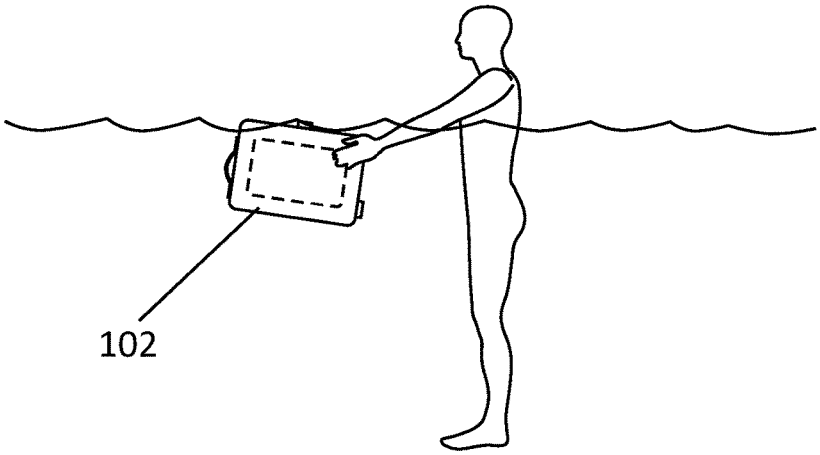

FIGS. 14-15 show two example alternative shapes of the container 102. The container 102 in FIG. 14 is a tear drop shape. The openable closure 104 in this example is a rolled top. The container 102 in FIG. 15 is an oval cylinder shape. The openable closure 104 is a zipper defined in the circumferential sidewall adjacent to the top surface. The stiffener sheet 112 is indicated in the sidewall. Both embodiments comprise a handle 108 and drain plug 110 as well. Of course other regular and irregular shapes of the container can be provided in further alternative embodiments, including for example pyramid, multi-sided prism, spherical and partially spherical (or any combination of shapes).

As illustrated in FIGS. 17-25, hook and loop-type fastener 114 such as VELCRO can be provided to adjacent respective side panels of the container 102 to releasably join or secure two or more containers 102 together in a monolithic assembly that has enhanced stability as the containers sit on a boat's floor or another surface. These same flat exterior surfaces comprising the hook and loop fasteners 114 can be used to temporarily attach the container to corresponding hook and loop fasteners mounted on portions of the boat to keep the container(s) stable and in place. Other types of fastening means can be used to attach one or more containers together (or to a boat structure), including buckles, straps 117 and temporary adhesives.

A cover 115 comprising a hinged flap or other piece of material can be provided can be provided to cover the section of hook and loop fastener 114 when not employed.

In a further embodiment, such as shown in FIGS. 4-6C, the container 102 of the ballast system 100 can be generally cube-shaped when filled with water, but the length, width and depth do not have to be the same. The top has no panel of its own, or just a partial panel, when void of liquid. The adjacent front, back, left side and right side panels extend vertically from a bottom panel to define an open or partially open top side. Water is filled using the top opening to a desired or marked height of the container. Then starting at the top of the top opening, the front and back sides of the flexible body material are brought together to touch in such a way that they can be rolled downward and together via multiple revolutions so that an air tight seal is formed. This forms the openable closure 104. A strap 105, hook and loop fastener 107 and buckle 109 can be used to hold the rolled top portion of the container in place so that the container remains water-tight.

An air release valve 106 can be installed near the top area of the container in a non-rolled portion. A handle or strap 108 on one or more of the side panels of the container 102 can be provided for easy handling. A plastic threaded plug 110 can be disposed in one or more of the vertical sides to allow for ease of emptying or to attach accessories as described for previous embodiments.

One or more of the side panels can include a sheet of stiffener material 112 as described above. Baffles and/or drop-stitching can also be provided as previously described.

An attachment means 114 for joining together two or more adjacent containers, or to secure containers to the boat structure, can again be provided. The attachment means can be hook and loop fastener, buckles, straps, etc.

Figure 4:
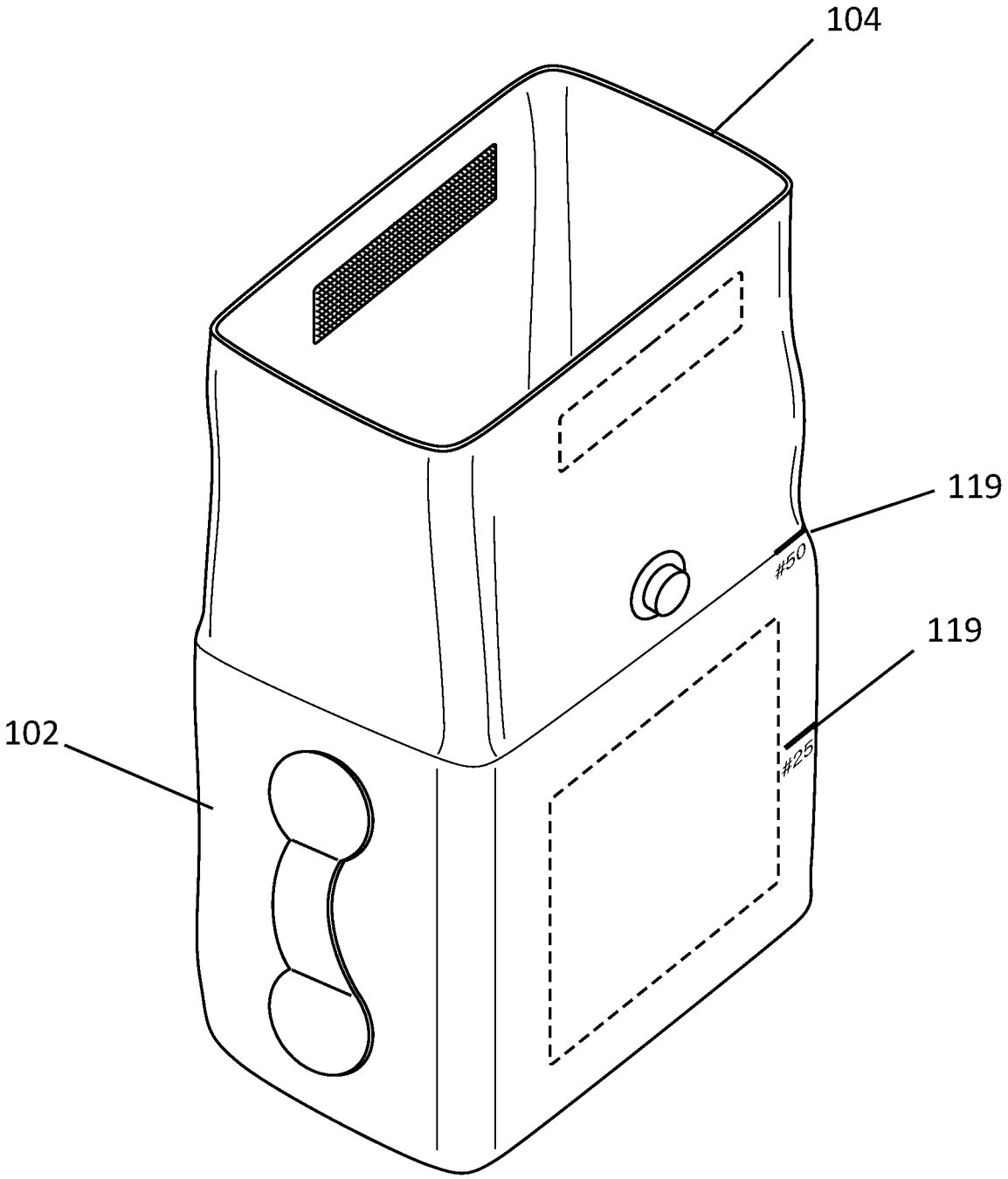
FIG. 4 is a perspective view of a portable water weight in accordance with certain aspects of the invention.
Figure 5:
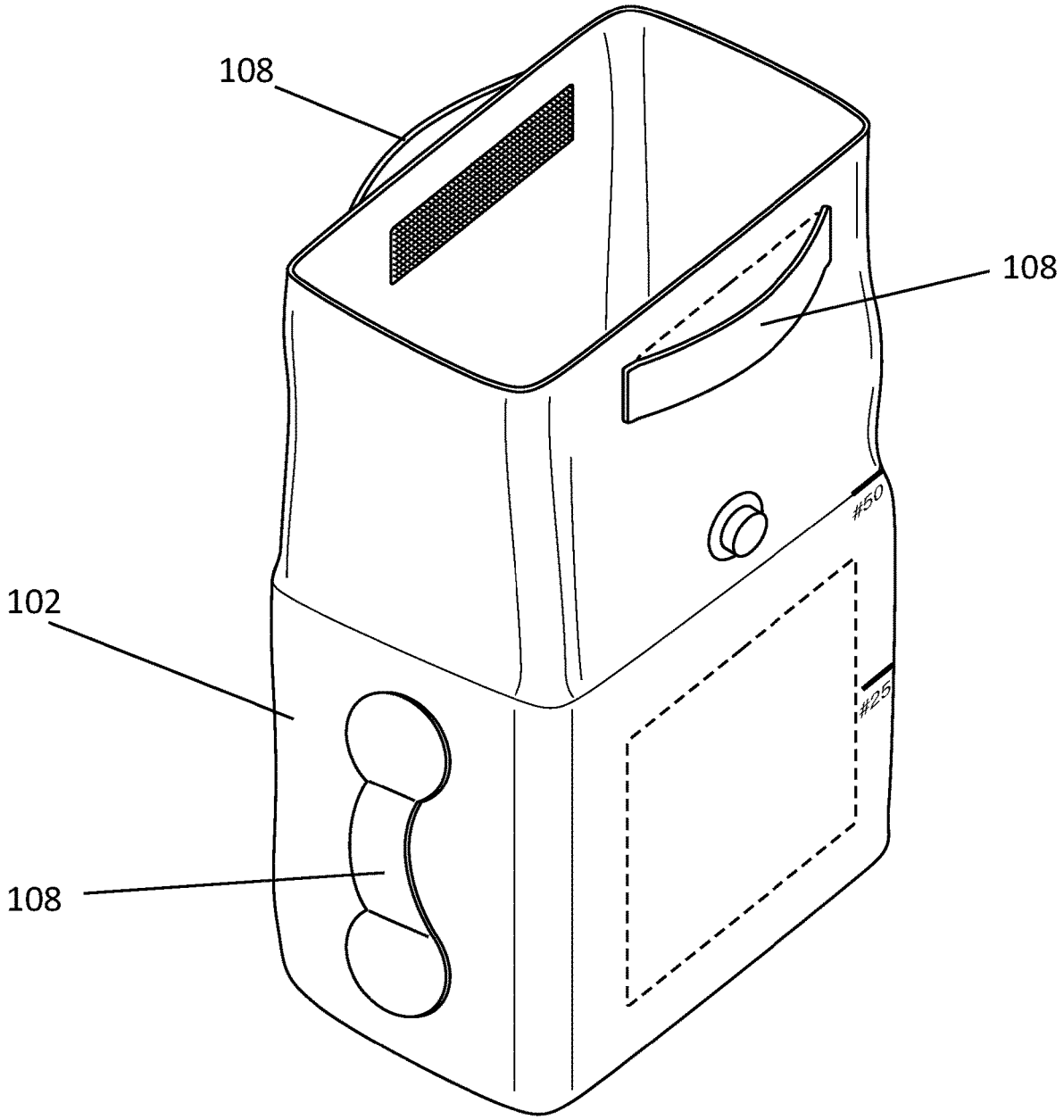
FIG. 5 is a perspective view of a portable water weight in accordance with certain aspects of the invention.

As shown in FIG. 4, markings 119 can be provided on the container to indicate fill lines to achieve a particular weight. For example, fill line markings 119 for 25 and 50 pounds are indicated in the container 102 in FIG. 4.

Figure 7:
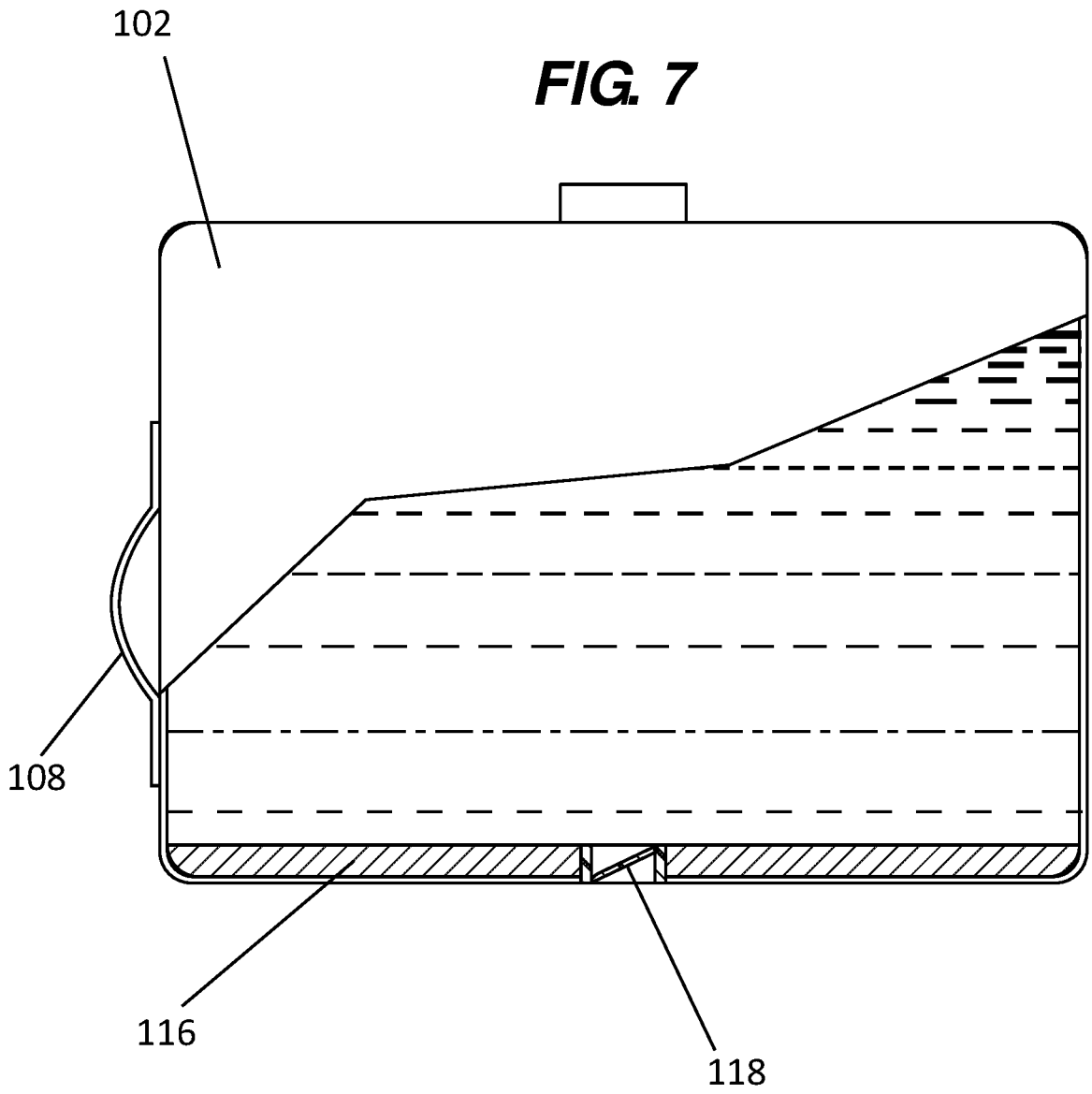
FIG. 7 is a front view of a portable water weight in accordance with certain aspects of the invention.

Referring specifically to FIG. 7, a static weight 116 can be disposed in the lower portions of the sidewalls and/or in the bottom of the container 102 to assist in sinking the container during the filling process.

Also referring to FIG. 7, an inlet can also be defined in the bottom of the container using a check valve or one-way valve 118 to allow water into the container 102 for filling but not allow the water out of the container through the valve 118. This embodiment can include the closures discussed previously, or there may be no opening in the top portion at all since it would not be necessary with the use of a bottom filling inlet valve 118.

Figure 8:
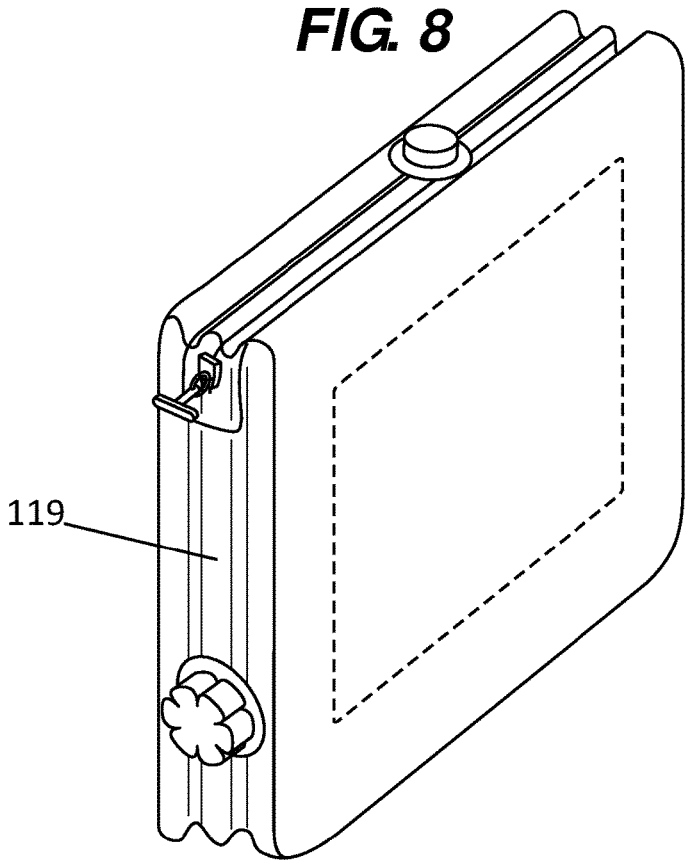
FIG. 8 is a perspective view of a portable water weight in accordance with certain aspects of the invention.
Figure 9:
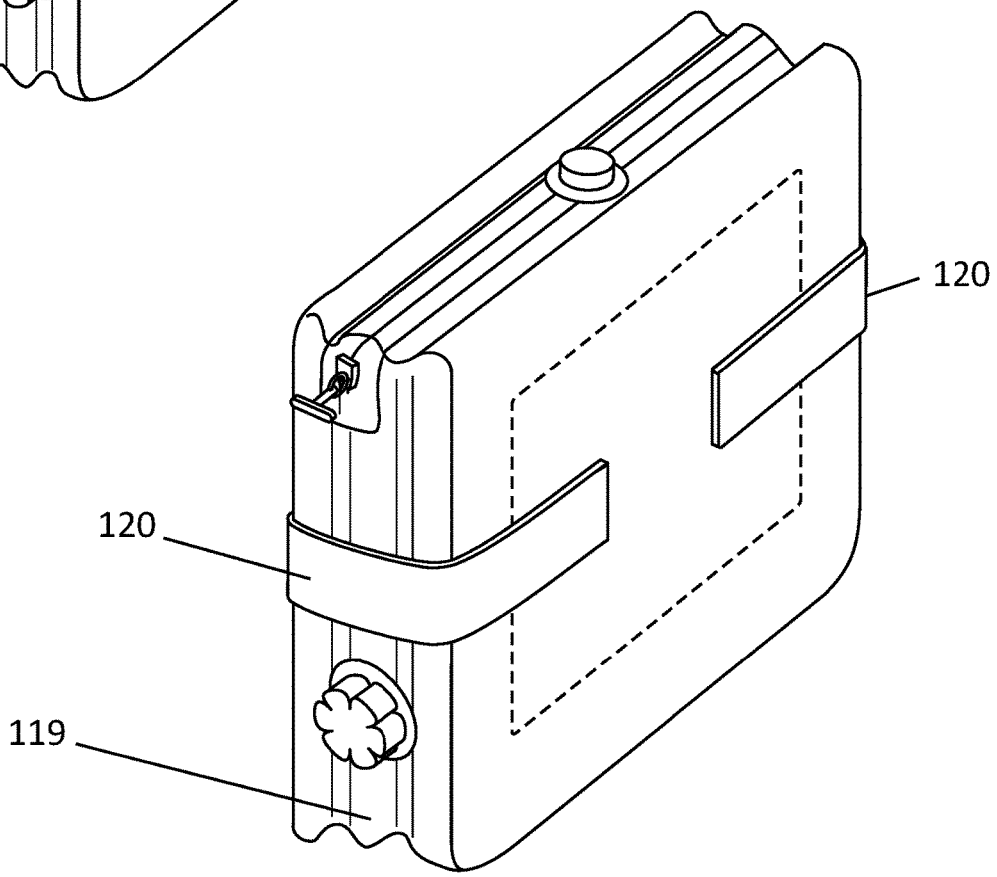
FIG. 9 is a perspective view of a portable water weight in accordance with certain aspects of the invention.
Figure 10:
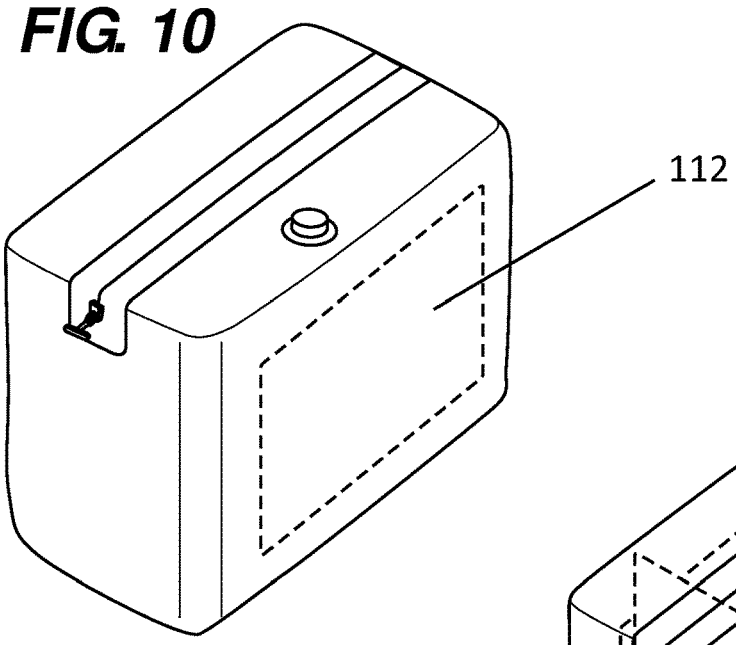
FIG. 10 is a perspective view of a portable water weight in accordance with certain aspects of the invention.
Figure 11:
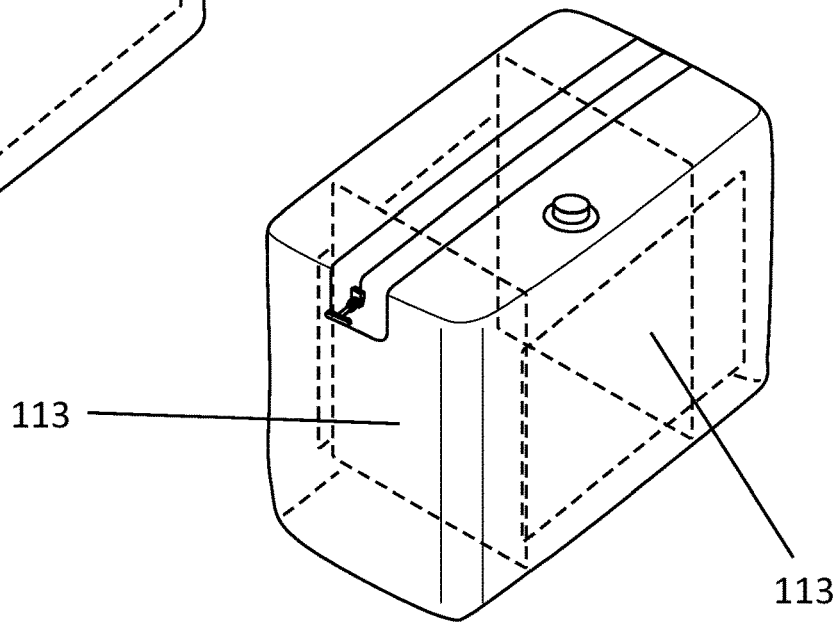
FIG. 11 is a perspective view of a portable water weight in accordance with certain aspects of the invention.

Referring to FIGS. 8-9, in certain embodiments, the container 102, when empty or partially filled, can be collapsed or folded to make it more compact for storage or to take up less space when less than the full water volume is needed. Two opposing side panels can be accordioned 121 to facilitate the collapsing feature. The top and bottom sides can be accordioned as well. Retention bands 120 can be secured across the contracted sides to keep the container 102 from expanding more than desired when empty or partially filled.

The water ballast system 100 is portable, compact and storable, requires no external pumps, is net neutral buoyant even while in use, and can be used individually or as a system with attachment features that are all independent. The water ballast system 100 is independent from the boat. Water in the container 102 can even be deployed for other uses, including rinsing, washing, cleaning the boat and decks, bathing, cooking and other domestic tasks.

Referring to FIGS. 26A-27D, in use, the container 102 of the water ballast system 100 can be filled by several manual techniques from in or on the boat, or from in the body of water, without the need for a separate pump.

Figure 27A:
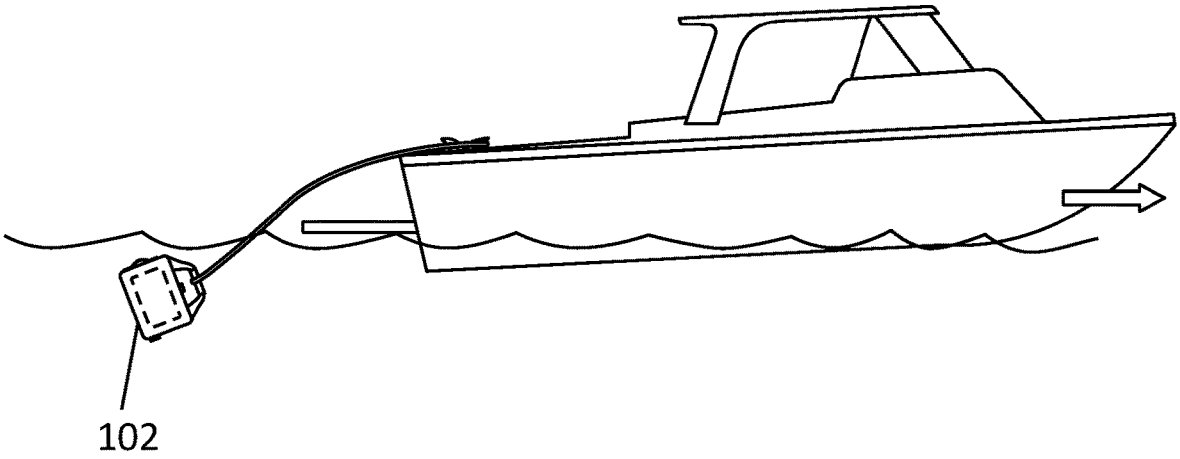
FIGS. 27A-27D are a series of diagrams showing a filling procedure for a portable water weight in accordance with certain aspects of the invention.
Figure 27B:
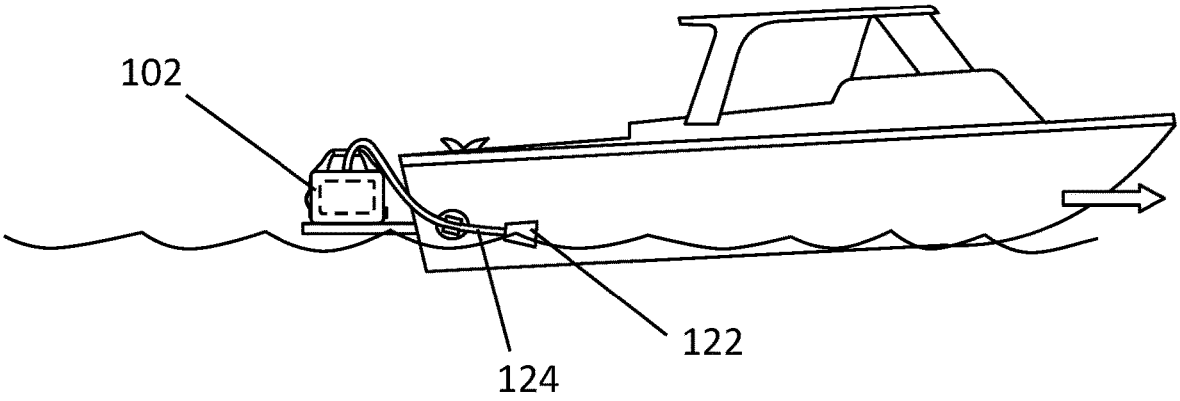
Figure 27D:
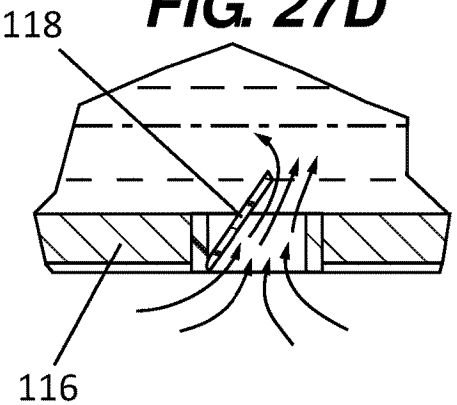

The container 102 can even be filled, for example, through its top opening or drain plug in an automated fashion by pulling behind a boat with a rope while the boat is operated at a slow speed (FIG. 27B).

In a further example, as shown in FIG. 27B, when the boat moves forward under its own power, water is forced through the inlet 122 of a fill conduit 124 coupled to an inlet valve of the container 102 to fill the container with water. The inlet 122 can be secured to the side of the boat for the filling operation so that water is forced through the conduit 124 and into the container 102.

Figure 27C:
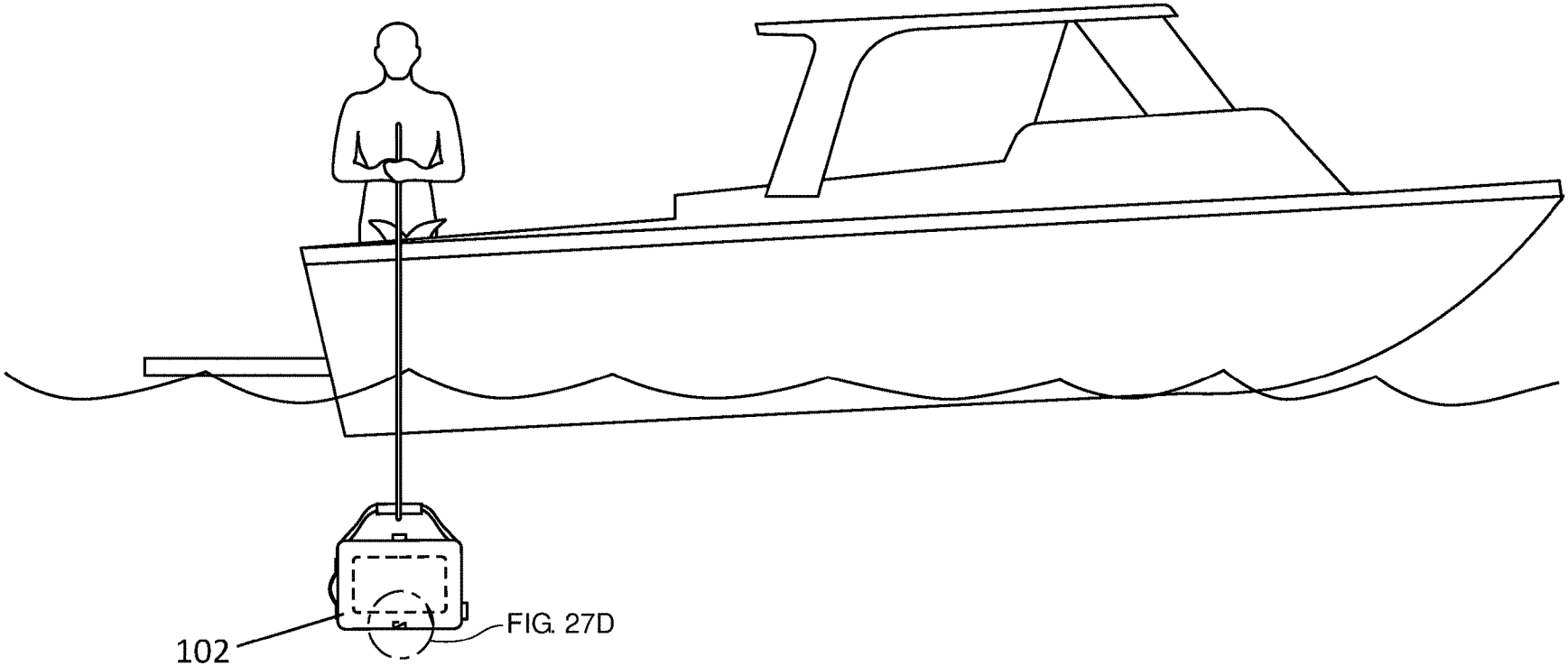

As described previously regarding FIG. 7 and referring additionally to the bottom diagram of FIG. 27C, a static weight 116 can be used to submerge the container 102 under the water line of the body of water to allow water to enter the container 102 through an opening in the bottom via a check valve 118 or in through a top opening described herein.

Figure 28:
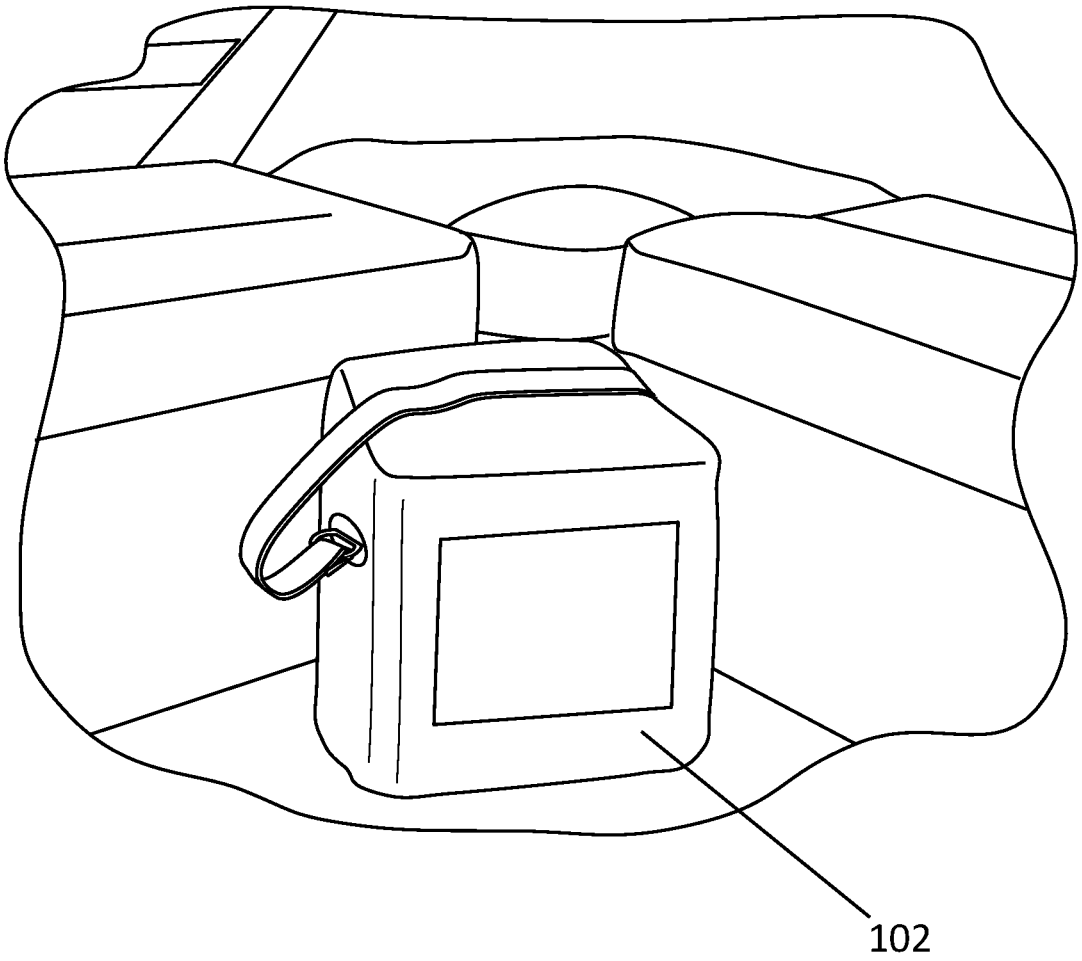
FIG. 28 is a perspective view of a portable water weight in use in accordance with certain aspects of the invention.

The filled ballast container 100 can be placed in the desired location inside of the boat such as shown in FIG. 28, wherein the container 102 is set on the floor of the boar adjacent to the boat's seats.

The ability to fill and empty the ballast container as needed saves fuel otherwise wasted hauling static weight around when not needed.

Since the container's walls are still malleable when filled with water, the container will not hurt someone if a toe or foot should hit the container, which is unlike a lead or sand-filled bag.

The water ballast system 100 described herein can also be used as a weight outside of the marine industry. For example, the container 102 can be used to weight down a tent or other lightweight temporary structure.

Further regarding embodiments can utilizes both liquid weight and some static weight like sand lead or other granular or solid material. The static weight can be located in or adjacent to the bottom portion of the device. The static weight can be in a separate compartment that is user-accessible, or can be permanently embedded into the container.

An accessible compartment for static weight allows standard, readily-available compact weight plates designed for sliding onto weight lifting bars to be used. Plus, the user can remove the static weight when not desired for use. With an accessible area defined in the bottom area of the container 102 such as shown in FIG. 7, it would not be necessary to manufacture, transport and sell the container with the weight included, which saves production and shipping cost. The user can then set the device up with no or any weight they desire.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A portable, pumpless liquid water weight ballast system, comprising:

a container comprising a flexible and waterproof material, and defining an open interior, wherein a pair of opposing side panels of the container are collapsible to permit contraction of the container along the pair of opposing side panels that are collapsible;

an openable zipper closure defined along a top side of the container so that the container can be sealed water-tight;

a first portion of hook and loop fastener disposed on a first planar portion of the container; and a handle coupled to the container.

2. The portable, pumpless liquid water weight ballast system of claim 1, further comprising a threaded fitting defined in the container and in communication with the open interior and a threaded closure that seals the threaded fitting.

3. The portable, pumpless liquid water weight ballast system of claim 2, further comprising a hose that can be coupled to the threaded fitting on a first end and a nozzle that can be coupled to an opposing second end of the hose.

4. The portable, pumpless liquid water weight ballast system of claim 1, further comprising a stiffener sheet disposed in one or more side panels of the container.

5. The portable, pumpless liquid water weight ballast system of claim 1, wherein the container is a rectangular shape.

6. The portable, pumpless liquid water weight ballast system of claim 1, wherein the openable closure is an interlocking seal.

7. The portable, pumpless liquid water weight ballast system of claim 1, further comprising at least one baffle disposed within the open interior of the container.

8. The portable, pumpless liquid water weight ballast system of claim 1, further comprising a second portion of hook and loop fastener disposed on a second planar portion the container, wherein the second portion of hook and loop fastener is an opposite configuration as compared to that of the first portion of hook and loop fastener.

9. The portable, pumpless liquid water weight ballast system of claim 1, further comprising a flap that covers over the first portion of hook and loop fastener.

10. The portable, pumpless liquid water weight ballast system of claim 1, wherein the container defines an open top side.

11. The portable, pumpless liquid water weight ballast system of claim 10, further comprising a strap positioned to hold a rolled portion of the container in a position that encloses the open top side.

12. The portable, pumpless liquid water weight ballast system of claim 1, further comprising a static weight provided to container.

13. The portable, pumpless liquid water weight ballast system of claim 1, wherein the container defines a pocket for receiving a removable static weight.

14. A portable, pumpless liquid water weight ballast system, comprising:

a container comprising a flexible and waterproof material, and defining an open interior, wherein a pair of opposing side panels of the container are collapsible to permit contraction of the container along the pair of opposing side panels that are collapsible;

an openable zipper closure defined along a top side of the container so that the container can be sealed water-tight;

a handle coupled to the container; and a one-way inlet valve defined in the container that is in communication with the open interior.

15. A portable, pumpless liquid water weight ballast system, comprising:

a first container comprising a flexible and waterproof material, and defining an open interior, wherein the first container includes an openable closure defined along a top side of the first container so that the first container can be sealed water-tight, and wherein the first container comprises a first portion of hook and loop fastener disposed on a first planar portion of the first container; and a second container comprising a flexible and waterproof material, and defining an open interior, wherein the second container includes an openable closure defined along a top side of the second container so that the second container can be sealed water-tight, and wherein the second container comprises a second portion of hook and loop fastener disposed on a second planar portion of the second container, wherein the second portion of hook and loop fastener is complimentary to the first portion of hook and loop fastener such that when the first and second portions of hook and loop fastener are aligned and brought into contact with one another, the respective first and second containers are secured together.

16. A method of providing portable ballast to a boat, the method comprising:

submerging a container comprising a flexible and waterproof material underwater to fill an open interior thereof with water from a body of water;

disposing a static weight in the container before submerging the container underwater;

sealing an openable zipper closure of the container to prevent water contained in the open interior from escaping the container; and disposing the container that has been filled with water and sealed in a boat.

17. The method of claim 16, further comprising grasping a handle coupled to the container.

18. The portable, pumpless liquid water weight ballast system of claim 1, further comprising an air release valve provided to a portion of the container that is in communication with the open interior.

* * * * *